US005141454A

United States Patent [19]

Garrett et al.

[11] Patent Number: 5,141,454

[45] Date of Patent: Aug. 25, 1992

[54] FILTERED ELECTRICAL CONNECTOR AND METHOD OF MAKING SAME

[75] Inventors: Roger L. Garrett, New Wilmington, Pa.; Mark J. Vanden Wymelenberg, Hubbard; Joseph H. Gladd, Cortland, both of Ohio

[73] Assignee: General Motors Corporation, Detroit, Mich.

[21] Appl. No.: 796,277

[22] Filed: Nov. 22, 1991

[51] Int. Cl.[5] ..... H01R 13/66

[52] U.S. Cl. ..... 439/620; 439/931; 333/185; 205/122

[58] Field of Search ..... 439/620, 931; 29/885; 205/118, 122, 159, 164, 167; 333/181-185

[56] References Cited

U.S. PATENT DOCUMENTS 4,977,668 12/1990 McKenzie, Jr. ..... 29/852
5,018,989 5/1991 Black et al. ..... 439/620
5,079,671 1/1992 Garrett et al. ..... 361/331

*Primary Examiner*—Gary F. Paumen
*Attorney, Agent, or Firm*—Francis J. Fodale

[57] ABSTRACT

A filtered electrical connector comprises a selectively plated insulator housing having a plurality of pin terminals and a like plurality of small electrical components. The insulator housing is made of a platable thermoplastic part and a non-platable thermoplasitc part is a two shot molding process. The platable thermoplastic part provides a row of terminal cavities and a predominate portion of the insulator housing surfaces. The non-platable thermoplastic part lines surfaces of the platable thermoplastic part that are adjacent exposed portions of the pin terminals and also partitions portions of the platable thermoplastic part to provide individual mounting sites for the small electrical component associated with each of the terminal cavities. The surfaces of the platable part are plated with a metal coating while the surfaces of the non-platable part are not so that each mounting site comprises a pair of spaced electrical contacts that are connected by conductive paths to their associated conductive terminal cavity and to an electrical shield (ground plane) respectively. The electrical components are attached to the mounting sites so that their spaced contacts engage the respective spaced electrical contacts at the mounting site and individual circuits through these electrical components are completed by inserting the pin terminals into their respective terminal cavities.

5 Claims, 2 Drawing Sheets

FILTERED ELECTRICAL CONNECTOR AND METHOD OF MAKING SAME

BACKGROUND OF THE INVENTION

This invention relates generally to electrical connectors and more specifically to filtered electrical connectors that have a plurality of electrical terminals and a like plurality of small electrical components such as capacitors, diodes, or the like for filtering the electrical signals passing through the terminals.

U.S. Pat. No. 5,018,989 granted to Teresa K. Black, James M. English and Michael S. Shank May 28, 1991 discloses a filtered electrical connector of this general type in which the several small electrical components for filtering are connected to their respective terminals by individual metal straps. The electrical components, which in this particular instance are diodes for filtering electrostatic discharges or electromagnetic impulses, are grounded by means of a metal shell that is secured to the connector housing to provide an electrical shield or ground plane.

This connector is typical of the filtered electrical connectors available today and illustrates their major drawback in that the connectors require the manufacture and assembly of several small components that add to their complexity and expense.

SUMMARY OF THE INVENTION

The object of this invention is to provide a filtered electrical connector that is simple in construction and inexpensive to manufacture.

Another object of this invention is to provide a filtered electrical connector that requires considerably fewer components that those exemplified by the prior art patent discussed above.

A feature of the invention is that the filtered electrical connector of this invention uses plated electrical paths between several electrical terminals and their respective electrical components thereby eliminating the need for several sheet metal straps or other separate electrical circuit components.

Another feature of this invention is that the filtered electrical connector uses a plated electrical shield or ground plane that eliminates the need for a separate metal shell to provide the ground plane.

Still another feature of the invention is that the connector housing is fabricated of platable and non-platable thermoplastic parts to facilitate plating of the electrical paths and shields.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 4:
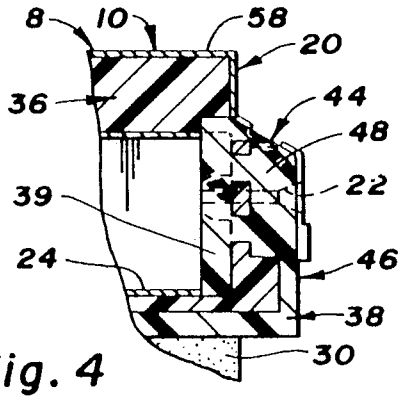
FIG. 4 is a section taken substantially along the line 4—4 of FIG. 1 looking in the direction of the arrows.

Referring now to the drawing the filtered electrical connector 8 of this invention comprises a selectively plated insulator housing 10, a plurality of electrical pin terminals 12, a like plurality of small electrical components, such as capacitors 14, a ferrite inductor 16 and two metal clips 18 for attaching the housing 10 to a printed circuit board (not shown).

Figure 3:
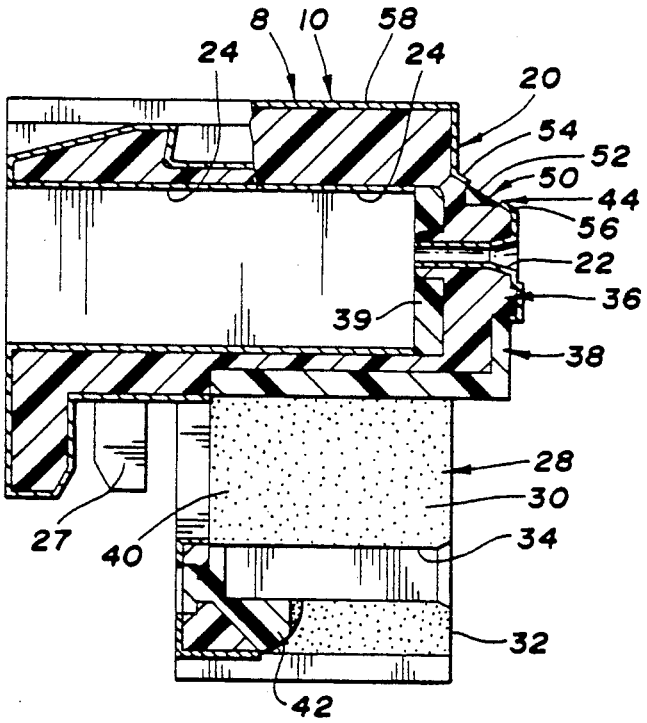
FIG. 3 is a section taken substantially along the line 3—3 of FIG. 1 looking in the direction of the arrows.

The insulator housing 10 has an upper connector portion 20 that includes a plurality of terminal cavities or bores 22 that are aligned in a row and receive portions of the respective pin terminals 12. These terminal bores 22 are flared at the rear of the connector portion 20 and extend through the housing 10 opening into an integral socket 24 at the front of the connector portion 20 as best shown in FIG. 3. The socket 24 is adapted to receive a mating electrical plug connector that carries mating female terminals (not shown). The socket 24 also has apertured ears 26 for fastening the insulator housing 10 to a metal support panel (not shown) that is suitably slotted to receive the front end portion of the socket 24 that is ahead of the apertured ears 26 and flange pieces 27. A suitable metal support panel might be for instance, the front wall of a metal radio case that holds the aforesaid printed circuit board and the electrical components carried by it.

Figure 1:
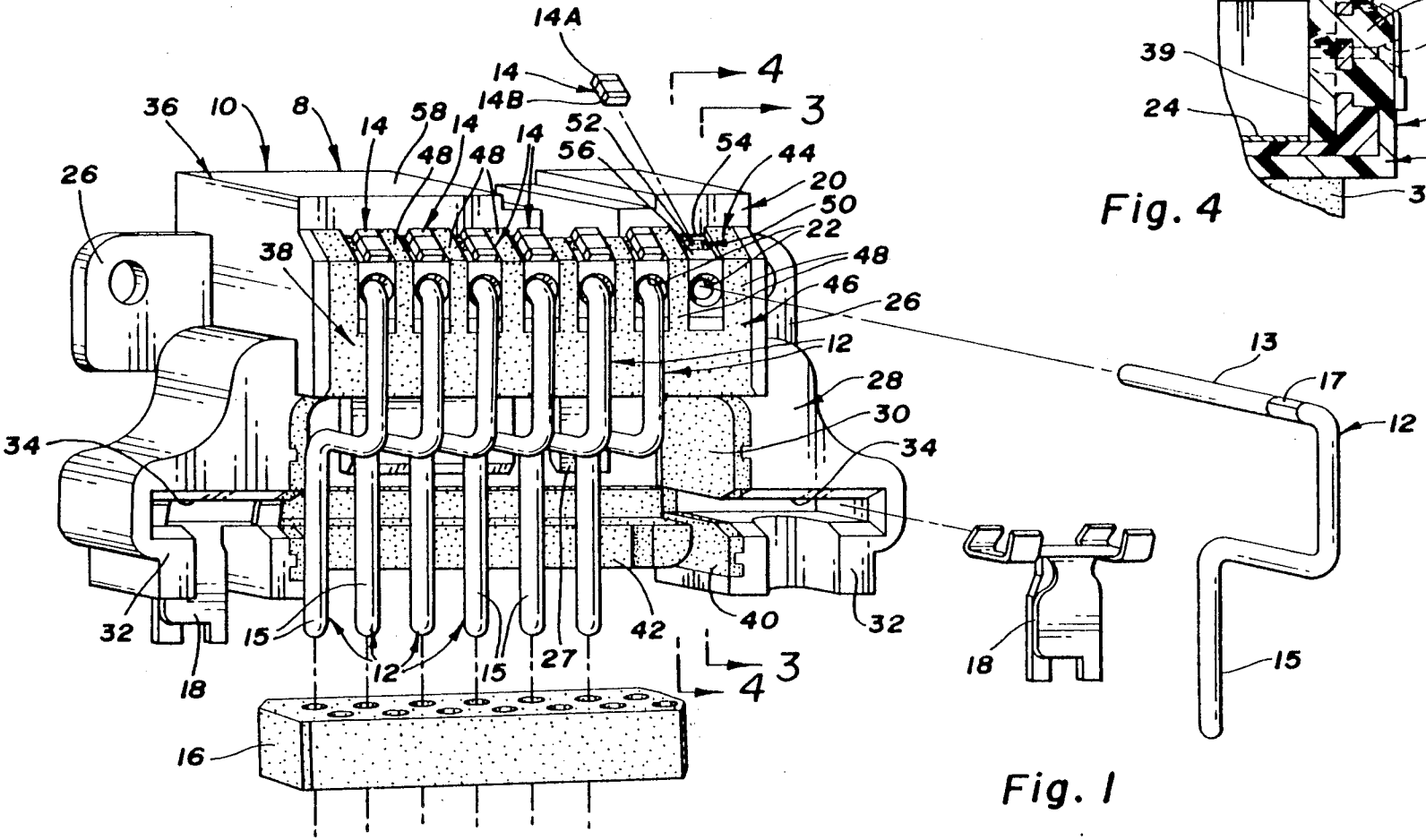
FIG. 1 is an exploded rear perspective view of a filtered electrical connector in accordance with our invention.
Figure 2:
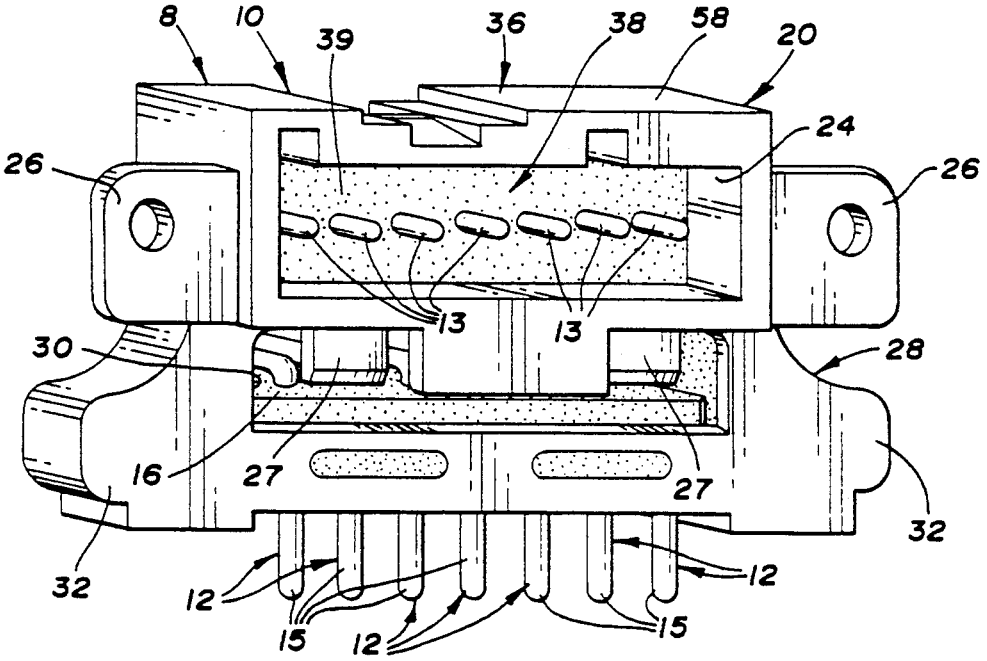
FIG. 2 is a front perspective view of the electrical connector shown in FIG. 1.

The insulator housing 10 also has a support portion 28 that attaches the insulator housing 10 to a printed circuit board. The support portion 28 is shaped to provide a central cavity 30 that is below the connector portion 20 and wider than the row of terminal cavities 22. The pin terminals 12 are generally L-shaped with an axial contact portion 13 and a stepped depending tail 15. The central cavity 30 receives the lower forwardly stepped portions of the tails 15 when the contact portions 13 of the electrical terminals 12 are assembled into the terminal cavities 22 of the insulator housing 10 as shown in FIGS. 1 and 2. The lower end of the tails 15 protrude through appropriately sized and spaced holes in the ferrite inductor 16 which is also housed in the central cavity 30.

The support portion 28 of the insulator housing 10 has a boss 32 at each side that is designed to rest on a printed circuit board. Each boss 32 has a generally T-shaped slot 34 that carries one of the metal clips 18 that attach the insulator housing 10 to the printed circuit board. The metal clips 18 are further described in U.S. Pat. No. 5,079,671, issued Jan. 7, 1992 and assigned to General Motors Corporation.

The insulator housing 10 is molded of two distinct thermoplastic materials in a two shot molding process. Basically these two thermoplastic materials are a platable thermoplastic material and a non-platable thermoplastic material that are integrated in such a way as to provide the desired electrical paths and shielding on the surfaces of the insulator housing 10 when the entire insulator housing 10 is plated.

From a material stand point, the insulator housing 10 comprises a preform or insert 36 of platable thermoplastic material, such as Polyetherimide (PEI), Polyarylsulfone (PAS), or Polyethersulfone (PES), and an overmold 38 of non-platable thermoplastic material, such as Polyphenolene Sulfide (PPS).

The platable housing preform or insert part 36 is molded in the first shot and then placed in a second mold where the moldover part 38 is molded in the second shot. The two part thermoplastic housing is then plated. As part of the plating process, the thermoplastic housing is subjected to an adhesion promotion step which typically is a chemical treatment to enhance the ability of the platable housing part 36 to accept plating. In essence, the exposed surfaces of the platable housing part 36 are chemically roughened, creating micropores which function as anchor sites for plating. The exposed surfaces of the non-platable housing part 38 are not effected by this adhesion promotion step.

The housing 10 is then plated by utilizing electroless plating to build conductive layers on the exposed surfaces of the platable thermoplastic part 36 that have been sensitized in the adhesion promotion step. Typically copper is applied to establish a conductive base surface. Final surface metalization may be achieved by electroless, electrolytic or immersion plating techniques. Metals that may be applied include nickel, tin, silver, palladium and gold. The exposed surfaces of the non-platable part 38 are not and cannot be plated during the plating process.

The platable housing preform part 36 includes most of the connector and support portions 20 and 28 of the insulator housing 10 which is evident from the plated metal coating illustrated in FIGS. 1, 2 and 3. In particular it should be noted that the platable housing part 36 provides each of the terminal cavities 22 in its entirety, and a predominate portion of the insulator housing surface so that the pin terminals 12 are substantially shielded against electromagnetic interference upon subsequent metal plating of housing part 36.

On the other hand, the non-platable moldover part 38 is basically a spacer and liner. It comprises a face plate 39 in the integral socket 24 that isolates the terminal cavities 22 from each other at their respective openings into the socket 24 to eliminate any bridges or shunts between the portions of the pin terminals 12 located in the socket 24. The sidewall of the socket 24 is not lined because the mating connector provides ample insulation and because the subsequent plating enhances electrical shielding.

The moldover part 38 further comprises a liner 40 for the central cavity 30 that receives the lower forwardly stepped portions of the tails 15 of the pin terminals 12 and the ferrite inductor 16. The liner 40 includes a spacer bar 42 below the ferrite inductor 16 that has a plurality of grooves for spacing the protruding lower ends of the terminal pins 12.

The insulator housing 10 has a plated component mounting bank 44 at the rear end of the insulator housing 10 above the row of terminal cavities 22 that is partially formed by the moldover part 38. More particularly the non-platable moldover part 38 includes a rear plate 46 having fingers 48 that partition the platable insert part 36 into individual mounting sites 50 in the rear end and slanted bank 44 for each of the terminal cavities 22. The rear plate 46 also has narrow bridges 52 extending between the finger portions in the mounting bank 44 so that the platable insert part 36 at each of the mounting sites 50 is divided into a pair of spaced contact supports 54 and 56.

As indicated above, the molded insulator housing 10 is plated in a process where all exposed surfaces of the platable preform part 36 are plated with a metal coating 58 while the exposed surfaces of the non-platable moldover part 38 are not. Consequently the terminal cavities 22, the contiguous portions at the rear face between the fingers 48 and the spaced contact supports 54 and 56 all have the metal coating 58 so that each mounting site 50 now comprises a pair of spaced electrical contacts that are connected by electrically conductive paths to their associated conductive terminal cavity and to the conductive shield 58 that is formed by the metal coating covering the predominant portion of the insulator housing surface respectively.

Thus electrical components 14 are simply attached to the mounting sites 50 by conventional soldering techniques which attach their spaced electrical contacts **14*a*, 14*b* to the respective spaced electrical contacts at the mounting sites 50. The individual circuits through these electrical components 14 are completed simply by inserting the axial contact portion 13 of pin terminals 12 into their respective terminal cavities 22. These axial portions 13 include deformed bands that have sharp edges 17 that dig into the metal coating 58 inside the terminal cavities 22 so as to establish a good electrical contact. The thickness of the metal coating 58 is exaggerated in the drawing for purposes of illustration. In practice the thickness of the metal coating 58** is about 250 microinches (0.00025 inches).

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising a selectively plated insulator housing having a plurality of electrical terminals and a like plurality of attachable electrical components, the insulator housing having a plurality of terminal cavities that receive portions of the electrical terminals respectively, and the insulator housing having a platable thermoplastic part and a non-platable thermoplastic part that are integrated in such a way as to provide a ground plane and a plurality of electrical paths for connecting each electrical terminal to the ground plane through a respective one of the electrical components when the insulator housing is plated in a process where exposed surfaces of the platable thermoplastic part are plated with a metal coating while exposed surfaces of the non-platable thermoplastic part are not.

2. An electrical connector comprising a selectively plated insulator housing having a plurality of pin terminals and a like plurality of small electrical components having spaced attachable electrical contacts, the insulator housing having a plurality of terminal cavities that receive portions of the pin terminals respectively, the insulator housing having a platable thermoplastic part that provides each of the terminal cavities and an electrical shield when coated with a metal, the insulator housing having a non-platable thermoplastic part that partitions the platable thermoplastic part into individual mounting sites for each of the terminal cavities that has a pair of spaced contact supports, the surfaces of the platable part being plated with a metal coating while the surfaces of the non-platable part are not so that each mounting site comprises a pair of spaced electrical contacts that are connected by conductive paths to an associated conductive terminal cavity and to the electrical shield respectively, the electrical components being attached to the mounting sites so that their spaced electrical contacts engage the respective spaced electrical contacts at the mounting site, and individual circuits through the electrical components being completed when axial contact portions of the pin terminals are inserted into the respective terminal cavities.

3. An electrical connector comprising a selectively plated insulator housing having a plurality of pin terminals and a like plurality of small attachable electrical components, the insulator housing having a row of terminal cavities that receive axial contact portions of the electrical pin terminals respectively and a bank at the rear end of the insulator housing above the row of terminal cavities for mounting the small electrical components on the insulator housing, the insulator housing having a platable thermoplastic part that provides a surface in each of the terminal cavities and a ground plane when coated with a metal, the insulator housing having a non-platable thermoplastic part that includes a plurality of laterally spaced fingers that partition the platable thermoplastic part to provide individual mounting sites for each of the terminal cavities that are at least partially located on the bank, the non-platable thermoplastic part further including narrow bridges extending between adjacent fingers so that the platable thermoplastic part at each of the mounting sites is divided into a pair of spaced contact supports on the bank, the surfaces of the platable part being plated with a metal coating while the surfaces of the non-platable part are not so that each mounting site comprises a pair of spaced electrical contacts that are connected by conductive paths to their associated conductive terminal cavity and to the ground plane respectively, the electrical components being attached to the mounting sites so that their electrical contacts engage the respective electrical contacts at the mounting site, and individual circuits through these electrical components being completed by inserting the axial contact portions of the pin terminals into their respective terminal cavities.

4. An electrical connector comprising a selectively plated insulator housing having a plurality of generally L-shaped pin terminals and a like plurality of small electrical components having spaced attachable electrical contacts, the insulator housing having a connector portion that has an integral socket communicating with a row of terminal cavities that receive portions of the pin terminals respectively, and a support portion for attaching the insulator housing to a printed circuit board, the support portion being shaped to provide a central cavity that is below and wider than the row of terminal cavities for receiving depending tails of the pin terminals, the insulator housing having a platable thermoplastic part that provides a surface in each of the terminal cavities and an electrical shield that provides a ground plane when coated with a metal, the insulator housing having a non-platable thermoplastic part that includes a face plate in the integral socket that isolates the terminal cavities from each other at their respective openings into the socket to eliminate any bridges or shunts between the terminal pins, a liner for the central cavity that receives the depending tails of the pin terminals and a rear plate at the rear of the connector portion that has fingers that partition the platable thermoplastic part to provide individual mounting sites for each of the terminal cavities and narrow bridges extending between adjacent fingers so that the platable thermoplastic part at each of the mounting sites is divided into a pair of spaced contact supports, the surfaces of the platable part being plated with a metal coating while the surfaces of the non-platable part are not so that each mounting site comprises a pair of spaced electrical contacts that are connected by conductive paths to their associated conductive terminal cavity and to the ground plane respectively, the electrical components being attached to the mounting sites so that their spaced electrical contacts engage the respective spaced electrical contacts at the mounting site, and individual circuits through the electrical components being completed by inserting the axial contact portions of the pin terminals into their respective terminal cavities.

5. The electrical connector as defined in claim 4 further including a ferrite conductor disposed in the central cavity of the support portion, the ferrite conductor having a plurality of spaced holes which receive respective forwardly stepped portions of depending tails of the generally L-shaped pin terminals, and the liner of the central cavity having a spacer bar below the ferrite inductor for spacing lower ends of the pin terminals protruding through the spaced holes of the ferrite inductor.

* * * * *